United States Patent [19]

Arikawa et al.

[11] 4,034,329

[45] July 5, 1977

[54] MINIATURE TIME-DELAY FUSE

[76] Inventors: Hiroo Arikawa, 1-14-9, Oyamadai, Setagaya, Tokyo; Masaya Maruo, 1-29-14, Shinkoyasu, Kanagawa, Yokohoma, both of Japan

[22] Filed: Apr. 30, 1976

[21] Appl. No.: 682,129

[30] Foreign Application Priority Data

May 2, 1975 Japan ..... 50-052563

[52] U.S. Cl. ..... 337/163; 337/166; 337/209

[51] Int. Cl.² ..... H01H 85/04; H01H 85/08

[58] Field of Search ..... 337/163, 166, 290, 293, 337/296

[56] References Cited

UNITED STATES PATENTS

| | | | |
|---|---|---|---|
| 2,773,960 | 12/1956 | Sundt et al. | 337/296 X |
| 3,706,951 | 12/1972 | Mikulecky | 337/166 X |

*Primary Examiner*—Robert J. Hickey

[57] ABSTRACT

A time-delay fuse is provided comprising a glass or ceramic tube sealed at both ends with a sealing means such as, e.g., ferrules. The fuse also comprises a generally cylindrical core member of poor heat conductivity (e.g., porous sintered mixture of alumina and clay), and a fusible high melting wire element wound densely on the middle region of said core member, thence sparsely toward the terminals and again densely at the ends where the fusible wire element is soldered by a high-melting solder element.

16 Claims, 3 Drawing Figures

MINIATURE TIME-DELAY FUSE

BACKGROUND OF THE INVENTION

There are a variety of types and sizes of fuses which are presently employed in different electrical and electronic circuits, and, indeed, their use in such circuits has been known for years. As it is well known, a fuse is a device intended to melt and open an electrical circuit whenever the ampere load on the circuit exceeds a predetermined safe value, i.e., the rated capacity of the fuse. However, in some circuits such as, for example in A-C motor circuits, the fuses open too quickly on moderate overloads. In order to overcome this difficulty, so-called time-delay (time-lag) fuses are employed which open the circuit only after an overload period of several times as long as that of an ordinary fuse.

Several types of time-delay fuses are now in use. One type, for example, known as the spring type fuse, comprises a fusible wire element held taught by a spring and soldered at both ends by means of a low melting point solder element. However, since relatively thin wire is taughtly held by the spring which exerts a tensile force upon the wire, it is usually weak against mechanical vibrations, and exhibits inferior shock resistance and other mechanical properties. Additionally, the low melting point of the solder, difficulty of maintaining adequate quantities of solder and special processing techniques needed to make them lead to great difficulties in mass producing this type of fuse at low manufacturing cost and with good mechanical stability.

Other types of time-delay fuses include a fuse which has a ceramic core wound by a fusible element and designed to interrupt so-called "arcing" in the fuse by absorbing the heat generated therein. Also, a fuse having a glass fiber wound by a fusible element is employed in order to interrupt arcing in the fuse by causing the glass fiber to melt simultaneously with the fusible element. However, all of these fuses exhibit inferior time delay characteristics and they are not entirely satisfactory in some circuits.

SUMMARY OF INVENTION

In accordance with this invention, a time-delay fuse is provided with remarkably superior time delay characteristics, greater impact resistance and mechanical stability than the fuses which have heretofore been employed in the prior art. The improved time-delay fuse of this invention comprises a generally cylindrical porous sintered core material with poor thermal conductivity (as will hereinafter be described in detail) and a fusible, high-melting wire element uniquely wound thereon. The fusible wire element is densely wound at the middle section of the cylindrical core material, then sparsely wound at the intermediate regions toward the terminal ends thereof, and again very densely wound at the ends of the cylindrical core material. The fusible wire element is then soldered at both ends with a sufficient amount of a high-melting solder and the cylindrical core material is then placed in a dielectric tube (e.g., a glass or ceramic tube) and is fixed therein by sealing means such as ferrules provided at both ends of the tube.

The time-delay fuse of this invention will now be described in detail with particular reference to the drawings which are made a part of this application. Similar character references are employed in the drawings to designate like parts.

DETAILED DESCRIPTION OF INVENTION

Figure 1:
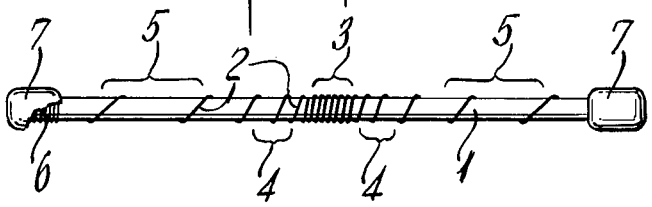
FIG. 1 is a side view of the cylindrical core material with the fusible wire element wound thereon in accordance with this invention.
Figure 2:
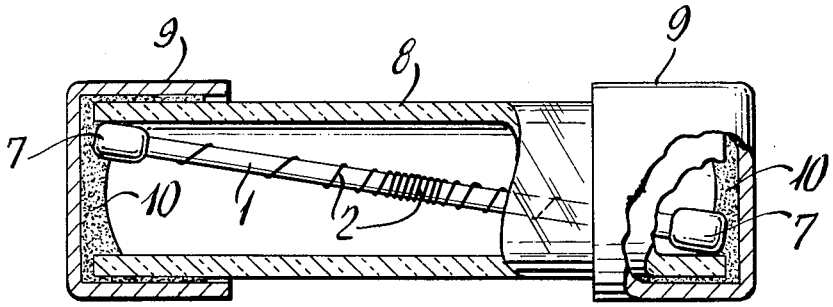
FIG. 2 is a side, partly sectional view of a time-delay fuse embodying the novel features of this invention.

Referring to FIGS. 1 and 2 of the drawings, there is shown an elongated, generally cylindrical shaped core member 1 wound with fusible wire element 2 such that the wire element is densely wound at the mid-section 3 of the cylindrical core member 1, then sparsely wound at the intermediate regions 5 and again densely wound at the ends 6 of the cylindrical core member 1 by means of adequate amounts of high-melting solder elements 7. The cylindrical core member 1 is then placed in a dielectric tubular member 8, such as a glass or ceramic tube, and sealed at both ends with a sealing means 9 such as, e.g., ferrules, and again soldered as in 10 using adequate amount of high-melting solder to insure good electrical contact and to rigidly maintain the cylindrical core member 1 in position.

The cylindrical core member 1 is made from a poorly heat conductive, porous sintered material comprising essentially of aluminum oxide (alumina; $Al_2O_3$) or a mixture of alumina and clay.

Although the relative compositions of alumina and clay may vary somewhat, we have found that the most suitable material is a porous sintered blend comprising essentially of from about 75 to about 90 weight percent alumina and from about 10 to about 25 weight percent clay. In addition, such alumina: clay mixtures which are resistant to temperatures of at least about 1600° C and which have a water absorption characteristics of from about 15 to about 20 weight percent are particularly preferable.

The fusible wire element 2 can be selected from a variety of available metals of high melting points and good electrical conductivity.

The advantages of this invention are best realized when the fusible wire element 2 is uniquely wound over the cylindrical core member 1 as described herein. Thus, the fusible wire element 2 is densely wound at the middle section 3 of the cylindrical core member at a pitch of from about 100/cm. to about 150/cm., thence sparsely at the middle region at a pitch of from about 2/cm. to about 8 per cm., and again densely wound at the ends at a pitch of from about 100/cm. to about 150/cm.

Since the time-delay fuses of this invention are generally made in miniature sizes, usually about 3 cm. long, for all practical purposes, the middle section of the cylindrical core member 1 is defined by a region approximately 1 cm. long, with the intermediate sections 5 being defined by the regions between the extremities of the middle sections 3 and the terminals or end sections 6 of the cylindrical core member. Obviously, these sections may vary in dimensions depending on the exact size of the fuse.

Furthermore, in order to obtain the designed rated current capacity, minimize the voltage drop and lower the temperature rise in the fuse, it is necessary to minimize the length of the fusible wire element 2 on the middle section 3 of the cylindrical core member 1.

Since the material selected for the cylindrical core member 1 is poor in its thermal conductivity, and since the fusible wire element 2 is sparsely wound at the intermediate sections 3, very little heat flows from the middle toward the ends of the fuse. Accordingly, the time-delay fuse of this invention exhibits superior time delay characteristics compared to the prior art fuses such as those in which the fusible wire element is wound over glass fiber.

We have also found that by winding the fusible wire element 2 over the cylindrical core member 1 in the unique manner described herein and by soldering the terminals of the wire by means of a high melting solder, wire slackening can be virtually eliminated. This is to be contrasted with the use of low melting eutectic solders which have caused slackening of the wire and have hence resulted in inferior fuses.

By way of example, and according to one specific embodiment of this invention, a time-delay fuse was made by winding a metallic wire over a cylindrical core member approximately 3 cm. long and few millimeters in diameter, made from 85 weight percent alumina and 15 weight percent clay. The wire was densely wound over the middle region of the cylindrical core member (a distance of approximately 1 cm.) at a pitch of 130/cm., thence sparsely toward the terminals at a pitch of 4/cm. and again densely at the ends at a pitch of 130/cm. The wire terminals were soldered at the ends by means of a high melting solder and the cylindrical core member was then fixed in a glass fuse tube. The rated current capacity of the fuse was 100 milliamperes according to class A melting Standards.

Figure 3:
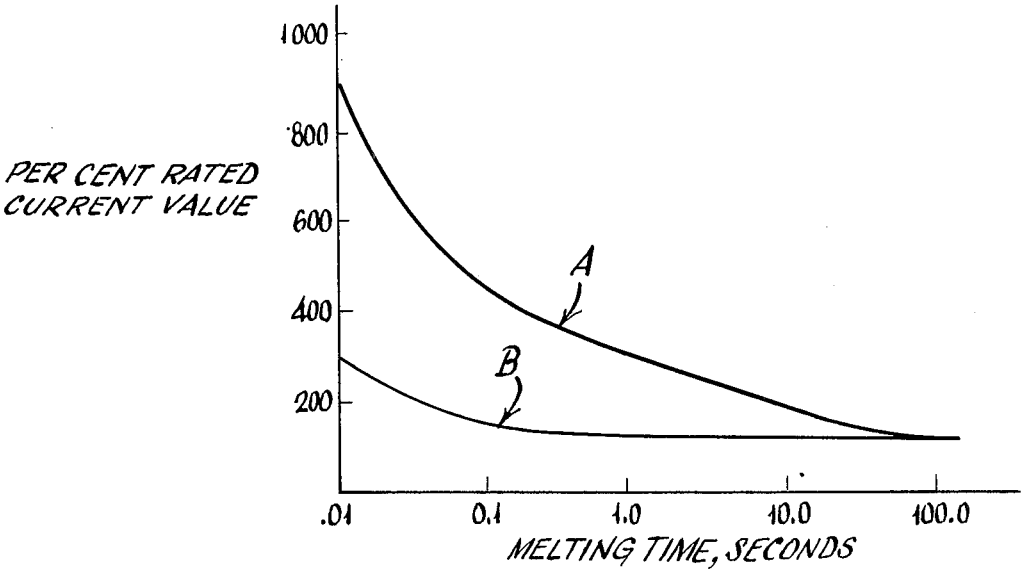
FIG. 3 compares the time delay characteristics of a fuse made in accordance with this invention with a time-delay fuse made in accordance with the prior art.

The time-delay characteristics of this fuse was compared with a prior art class A fuse having similar rated current capacity, and the results were plotted (FIG. 3) as percent rated current value vs. melting time, in seconds. As shown in FIG. 3 Curves A and B represent the relationships obtained, respectively, for a fuse made in accordance with the aforementioned example and an ordinary type fuse. These curves clearly indicate that the fuse of this invention exhibits superior time delay characteristics.

Although the invention has heretofore been described with certain degrees of particularity, neither the detailed description thereof nor the description of its specific embodiment is intended to limit the scope of this invention since obvious modifications can be made therein without necessarily departing from the scope or spirit of this invention. Such modifications will readily suggest themselves to those skilled in the art from the foregoing descriptions.

Also, the time-delay fuses of this invention can be readily mass produced in miniature sizes and at moderate costs while still retaining their improved time delay characteristics and excellent mechanical stability.

What is claimed is:

1. An electrical component for use in a time-delay fuse comprising an elongated generally cylindrical core member of low heat conductivity defined by a middle region, two intermediate regions and two ends, and a fusible metallic wire element of high melting point wound on said core member, said fusible wire element being densely wound at said middle region, thence sparsely wound toward the ends of said core member and again densely wound at said ends, and wherein said fusible wire element is soldered at said ends with a high melting solder element.

2. An electrical component as in claim 1 wherein said core member is a material selected from the group consisting of alumina and mixture comprising substantially of alumina and clay having a melting point of at least about 1600° C.

3. An electrical component as in claim 2 wherein said mixture comprises substantially of from about 75 to about 90 weight percent alumina and from about 10 to about 25 weight percent clay having water absorption capacity of from about 15 to about 20 weight percent.

4. An electrical component as in claim 3 wherein said mixture comprises essentially of from about 85 weight percent alumina and about 15 weight percent clay.

5. An electrical component as in claim 1 wherein said fusible metallic wire element is wound at said middle and end regions of said cylindrical core member at a pitch of from about 100/cm. to about 150/cm. and at said middle region at a pitch of from about 2/cm. to about 8/cm.

6. An electrical component as in claim 2 wherein said fusible metallic wire element is wound at said middle and end regions of said cylindrical core member at a pitch of from about 100/cm. to about 150/cm. and at said middle region at a pitch of from about 2/cm. to about 8/cm.

7. An electrical component as in claim 3 wherein said fusible metallic wire element is wound at said middle and end regions of said cylindrical core member at a pitch of from about 100/cm. to about 150/cm. and at said middle region at a pitch of from about 2/cm. to about 8/cm.

8. An electrical component as in claim 4 wherein said fusible metallic wire element is wound at said middle and end regions of said cylindrical core member at a pitch of from about 100/cm. to about 150/cm. and at said middle region at a pitch of from about 2/cm. to about 8/cm.

9. A time-delay fuse having improved time delay characteristics comprising a tubular member having two ends, sealing means at said ends, an elongated generally cylindrical core member of poor thermal conductivity defined by a middle region, two intermediate regions and two ends, a fusible metallic wire element of high melting point wound densely at said middle region, thence sparsely at said intermediate regions and densely at said ends of said cylindrical core member, said fusible metallic wire element being soldered to said ends of said cylindrical core member by a high-melting solder element.

10. A time-delay fuse as in claim 9 wherein said core member is a material selected from the group consisting of alumina and mixture comprising substantially of alumina and clay having a melting point of at least about 1600° C.

11. A time-delay fuse as in claim 10 wherein said mixture comprises substantially of from about 75 to about 90 weight percent alumina and from about 10 to about 25 weight percent clay.

12. A time-delay fuse as in claim 11 wherein said mixture comprises essentially of about 85 weight percent alumina and about 15 weight percent clay.

13. A time-delay fuse as in claim 9 wherein said fusible metallic wire element is wound at said middle and end regions of said cylindrical core member at a pitch of from about 100/cm. to about 150/cm. and at said middle region at a pitch of from about 2/cm. to about 8/cm.

14. A time-delay fuse as in claim 10 wherein said fusible metallic wire element is wound at said middle and end regions of said cylindrical core member at a pitch of from about 100/cm. to about 150/cm. and at said middle region at a pitch of from about 2/cm. to about 8/cm.

15. A time-delay fuse as in claim 11 wherein said fusible metallic wire element is wound at said middle and end regions of said cylindrical core member at a pitch of from about 100/cm. to about 50/cm. and at said middle region at a pitch of from about 2/cm. to about 8/cm.

16. A time-delay fuse as in claim 12 wherein said fusible metallic wire element is wound at said middle and end regions of said cylindrical core member at a pitch of from about 100/cm. to about 150/cm. and at said middle region at a pitch of from about 2/cm. to about 8/cm.

* * * * *